US008444238B2

(12) United States Patent
Choi

(10) Patent No.: US 8,444,238 B2
(45) Date of Patent: May 21, 2013

(54) REFRIGERATOR

(75) Inventor: Changbong Choi, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 65 days.

(21) Appl. No.: 12/747,550

(22) PCT Filed: Dec. 10, 2008

(86) PCT No.: PCT/KR2008/007316

§ 371 (c)(1),
(2), (4) Date: Jun. 11, 2010

(87) PCT Pub. No.: WO2009/075523

PCT Pub. Date: Jun. 18, 2009

(65) Prior Publication Data

US 2010/0263403 A1 Oct. 21, 2010

(30) Foreign Application Priority Data

Dec. 12, 2007 (KR) ..... 10-2007-0129131

(51) Int. Cl.
*A47B 96/00* (2006.01)

(52) U.S. Cl.
USPC ..... 312/405; 16/244

(58) Field of Classification Search
USPC ..... 16/240, 241, 244, 245; 312/405, 312/401, 405.1, 319.2, 329, 326, 296; 49/388, 49/381, 385
See application file for complete search history.

(56) References Cited

U.S. PATENT DOCUMENTS

| | | | | | |
|---|---|---|---|---|---|
| 3,222,711 | A | * | 12/1965 | Cecala | 16/243 |
| 3,299,573 | A | * | 1/1967 | Gustafson | 49/388 |
| 3,592,257 | A | * | 7/1971 | Matyas | 160/186 |
| 3,651,538 | A | * | 3/1972 | Jentsch | 16/248 |
| 3,662,493 | A | * | 5/1972 | Foltz | 49/388 |
| 3,683,453 | A | * | 8/1972 | McLeland et al. | 16/248 |
| 3,805,324 | A | * | 4/1974 | Johnson | 16/244 |
| 3,866,658 | A | * | 2/1975 | Smith | 160/206 |
| 4,070,728 | A | * | 1/1978 | Herman | 16/243 |
| 4,090,274 | A | * | 5/1978 | Bourgeois | 16/317 |

(Continued)

FOREIGN PATENT DOCUMENTS

| | | | |
|---|---|---|---|
| CN | 1862174 | A | 11/2006 |
| KR | 10-20060080856 | A | 7/2006 |

(Continued)

OTHER PUBLICATIONS english translation of KR20060133196 (A) Dec. 26, 2006.*

(Continued)

*Primary Examiner* — James O Hansen
*Assistant Examiner* — Hiwot Tefera
(74) *Attorney, Agent, or Firm* — Fish & Richardson P.C.

(57) ABSTRACT

A refrigerator is provided. The refrigerator includes a body, a door, a support bracket, a door bracket, a fixing part, and an adjustment part. The body defines a storage chamber. The door opens and closes the storage chamber. The door is rotatably coupled to the body by a hinge. The support bracket supports a load of the door. The door bracket is coupled to a lower side of the door. The fixing part is disposed between the support bracket and the door bracket. The adjustment part is coupled to the fixing part and supports the door bracket to adjust a vertical movement of the door.

12 Claims, 3 Drawing Sheets

U.S. PATENT DOCUMENTS

| | | | | |
|---|---|---|---|---|
| 4,151,681 | A * | 5/1979 | Roberts | 49/382 |
| 4,494,275 | A * | 1/1985 | Hsi-Shan | 16/314 |
| 4,667,367 | A * | 5/1987 | White et al. | 16/258 |
| 4,864,691 | A * | 9/1989 | Gidseg et al. | 16/312 |
| 4,956,940 | A * | 9/1990 | Touton, III | 49/388 |
| 4,977,642 | A * | 12/1990 | Marinoni | 16/257 |
| 5,333,355 | A * | 8/1994 | Beswick et al. | 16/300 |
| 5,369,842 | A * | 12/1994 | Beatty | 16/317 |
| 5,548,869 | A * | 8/1996 | Ryczek | 16/93 R |
| 6,138,341 | A * | 10/2000 | Barroero et al. | 29/527.1 |
| 6,757,938 | B1 * | 7/2004 | di Vinadio | 16/242 |
| 6,925,685 | B2 * | 8/2005 | Chen | 16/332 |
| 7,111,363 | B2 * | 9/2006 | Lee et al. | 16/376 |
| 7,490,384 | B2 * | 2/2009 | Lee | 16/244 |
| 7,685,678 | B2 * | 3/2010 | Moon et al. | 16/243 |
| 2002/0139908 | A1 * | 10/2002 | Oyama et al. | 248/188.8 |
| 2003/0159247 | A1 * | 8/2003 | Schott | 16/244 |
| 2005/0262663 | A1 * | 12/2005 | Lee | 16/221 |
| 2006/0143860 | A1 | 7/2006 | Park et al. | |
| 2006/0244351 | A1 * | 11/2006 | Moon et al. | 312/405 |
| 2008/0047101 | A1 * | 2/2008 | Petermann et al. | 16/240 |
| 2008/0201902 | A1 * | 8/2008 | Moon et al. | 16/244 |
| 2008/0209679 | A1 * | 9/2008 | Erickson et al. | 16/245 |
| 2011/0001413 | A1 * | 1/2011 | Park | 312/405 |
| 2011/0041288 | A1 * | 2/2011 | Pacini | 16/244 |
| 2011/0140585 | A1 * | 6/2011 | Lee et al. | 312/405 |

FOREIGN PATENT DOCUMENTS

| | | | |
|---|---|---|---|
| KR | 10-20060111211 | A | 10/2006 |
| KR | 10-20060133196 | A | 12/2006 |
| WO | WO 2007094523 | A1 * | 8/2007 |

OTHER PUBLICATIONS

International Search Report dated Apr. 6, 2009 for Application No. PCT/KR2008/007316, 2 pages.

Chinese Office Action dated Oct. 26, 2011 for Application No. 200880120329.4. with English translation, 11 pages.

* cited by examiner

REFRIGERATOR

TECHNICAL FIELD

Embodiments relate to a refrigerator.

BACKGROUND ART

In general, a refrigerator is an appliance for storing foods at a low temperature.

The refrigerator can be categorized into a top mount-type refrigerator with a freezing compartment provided above a refrigerating compartment, a bottom freezer-type refrigerator with a freezing compartment provided under a refrigerating compartment, and a side by side-type refrigerator with a freezing compartment and a refrigerating compartment positioned to the left and right of one another.

The freezing compartment and the refrigerating compartment are shielded by doors, respectively. Each of the doors is pivotally or slidingly opened and closed according to types of the refrigerator.

In case of the bottom freezer-type refrigerator and the side by side-type refrigerator of the refrigerator, a refrigerating compartment door and a freezing compartment door are positioned to left and right of one another as viewed from the front side. At this time, in an assembly process of the refrigerator, the refrigerating compartment door and the freezing compartment door may be different in height due to a size difference between the doors. Thus, a structure capable of matching the heights of the refrigerating compartment door and the freezing compartment door is required.

DISCLOSURE OF INVENTION

Technical Problem

Embodiments provide a refrigerator in which a door can be vertically moved to adjust a height of the door by performing a simple manipulation and providing a simplified structure.

Technical Solution

In one embodiment, a refrigerator includes: a body defining a storage chamber; a door opening and closing the storage chamber, the door being rotatably coupled to the body by a hinge; a support bracket supporting a load of the door; a door bracket coupled to a lower side of the door; a fixing part between the support bracket and the door bracket; and an adjustment part coupled to the fixing part and supporting the door bracket to adjust a vertical movement of the door.

In another embodiment, a refrigerator includes: a body defining a storage chamber; a door opening and closing the storage chamber, the door being rotatably coupled to the body by a hinge; a support bracket fixed to the body;

a door bracket coupled to a lower side of the door; a fixing part passing through the door bracket, the fixing part being supported by the support bracket; and an adjustment part supporting the door bracket, the adjustment part being relatively movably coupled to the fixing part, whether the door is moved upwardly or downwardly according to a movement of the adjustment part.

In a further embodiment, a refrigerator includes: a body defining a storage chamber; a door opening and closing the storage chamber, the door being rotatably coupled to the body by a hinge; a support bracket fixed to the body;

a door bracket coupled to a lower side of the door; a fixing part provided on the support bracket; and an adjustment part supporting the door bracket, the adjustment part being rotatably coupled to the fixing part, wherein the door is upwardly moved when the adjustment part is rotated in one direction, and the door is downwardly moved when the adjustment part is rotated in the other direction.

Advantageous Effects

According to imposed embodiments, since the door can be vertically moved by the adjustment part, the door is moved upwardly or downwardly using the adjustment part when a pair of doors are different in height. Therefore, the pair of doors can have the same height as each other.

Also, the tool such as the wrench is inserted into a gap between the support bracket and the door to rotate the adjustment part in one direction, thereby to move vertically the door. Therefore, a height difference can be simply adjusted by moving one door upwardly or downwardly to improve user's convenience.

In addition, since the user does not have to insert a hand into the gap between the support bracket and the door in order to move the door upwardly or downwardly, it can prevent the hand from being damaged by being put between the door and the support bracket.

MODE FOR THE INVENTION

Reference will now be made in detail to the embodiments of the present disclosure, examples of which are illustrated in the accompanying drawings.

Figure 1:
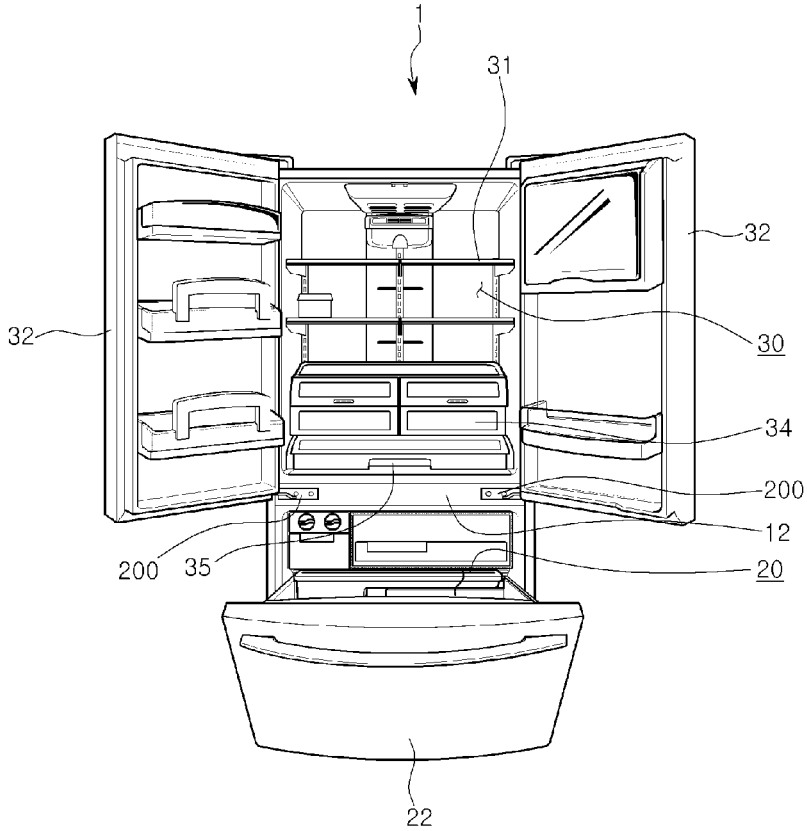
FIG. 1 is a front view illustrating the inside of a refrigerator according to an embodiment.
Figure 2:
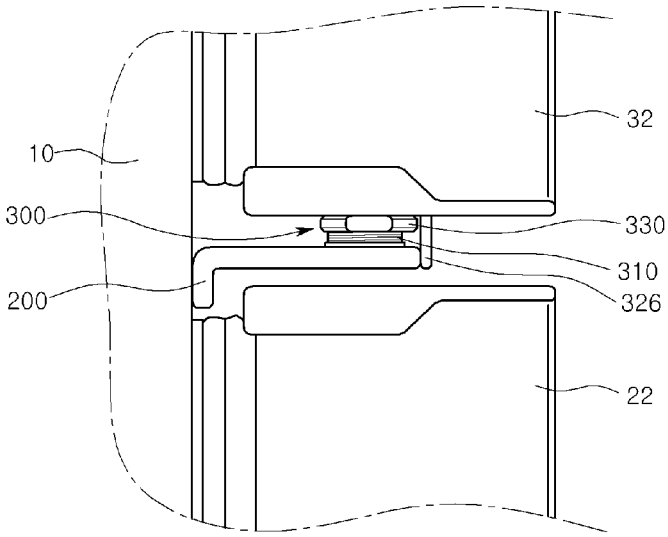
FIG. 2 is a partially enlarged side view illustrating a portion of a side surface of a refrigerator according to an embodiment.

FIG. 1 is a front view illustrating the inside of a refrigerator according to an embodiment, and FIG. 2 is a partially enlarged side view illustrating a portion of a side suffice of a refrigerator according to an embodiment.

Although a bottom freezer-type refrigerator is illustrated as an example in FIGS. 1 and 2, the present disclosure is not limited thereto. For example, various types of refrigerators in which doors are faced to each other such as a side by side-type refrigerator may be applicable.

Referring to FIGS. 1 and 2, a refrigerator 1 according to this embodiment includes a body 10 defining an outer appearance of the refrigerator 1.

The body 10 is partitioned into an upper portion and a lower portion by a barrier 12 to define a freezing compartment 20 and a refrigerating compartment 30.

Doors 22 and 32 are provided on a front suffice of the body 10 to selectively shield storage spaces, respectively. The doors 22 and 32 include a freezing compartment door 22 for shielding the freezing compartment 20 and a refrigerating compartment door 32 for shielding the refrigerating compartment 30.

The freezing compartment door 22 provided with a drawer-type door is moved in front and rear directions to open and close an entire suffice of the freezing compartment 20.

The refrigerating compartment 30 is disposed above the freezing compartment 20.

An inner space of the refrigerating compartment 30 is partitioned into a plurality of spaces by shelves 31.

The refrigerating compartment 30 is shielded by a pair of refrigerating compartment doors 32 facing each other.

Upper and lower ends of left and right sides of the pair of refrigerating compartment doors 32 are hinge-coupled to an upper end of the body 10 and left and right ends of the barrier 12.

Support brackets 200 are provided under the left and right sides of the pair of refrigerating compartment doors 32 to support a load of each refrigerating compartment door 32. The refrigerating compartment door 32 is rotatably coupled to the support bracket 200 by a hinge assembly 100.

A height adjustment unit 300 is disposed between the hinge assembly 100 and the support bracket 200 such that the refrigerating compartment door 32 is vertically moved to adjust a height of the refrigerating compartment door 32.

Figure 3:
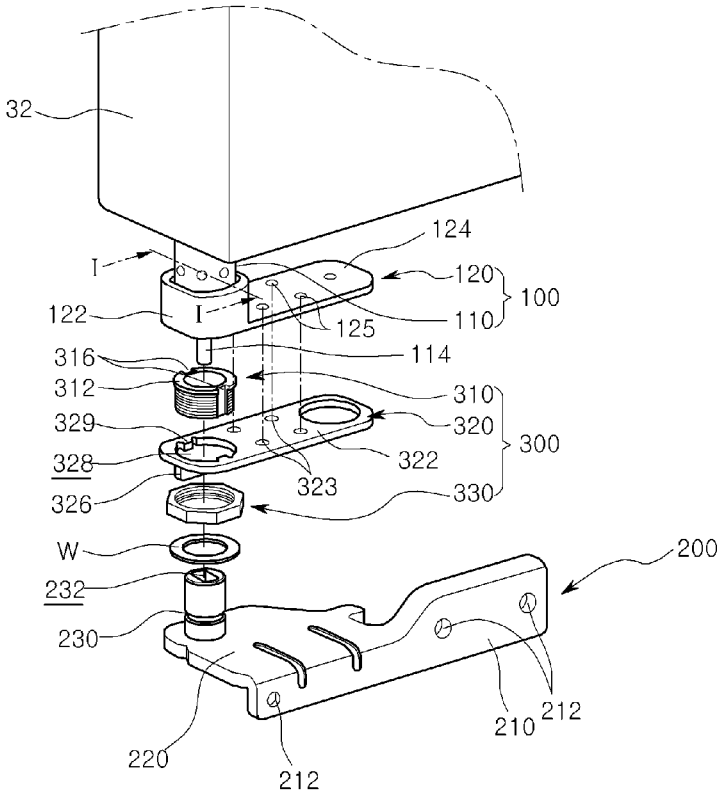
FIG. 3 is a exploded perspective view of a hinge assembly and a height adjustment unit according to an embodiment.
Figure 4:
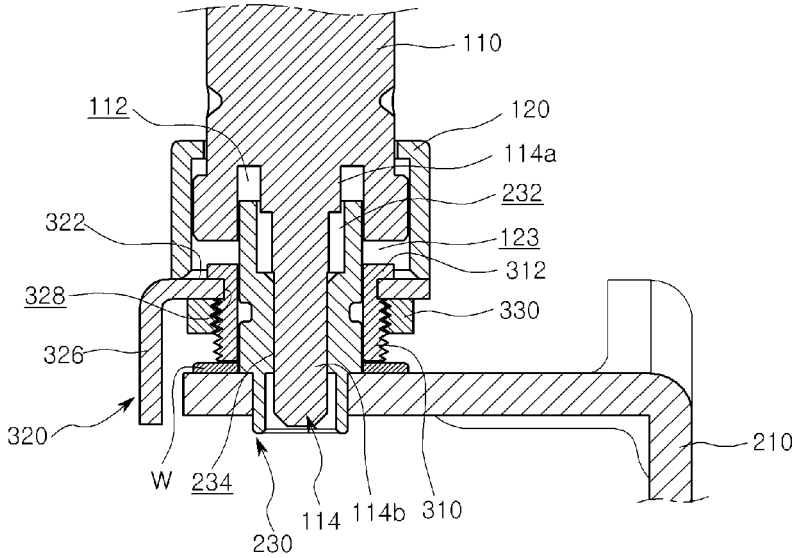
FIG. 4 is a cross-sectional view taken along line I-I of FIG. 3.

FIG. 3 is a exploded perspective view of a hinge assembly and a height adjustment unit according to an embodiment, and FIG. 4 is a cross-sectional view taken along line I-I of FIG. 3.

Referring to FIGS. 3 and 4, a hinge hole (not shown) receiving the hinge assembly 100 is defined in the lower end of the refrigerating compartment door 32.

The hinge assembly 100 includes a hinge 110 and a hinge stopper 120. The hinge 110 is inserted into the hinge hole and has one end protruding downwardly from the refrigerating compartment door 32. The hinge stopper 120 is fixed to an outer suffice of one end of the hinge 110.

The hinge 110 includes an auto closing hinge in which the refrigerating compartment door 32 is automatically closed when the refrigerating compartment door 32 is rotated within a predetermined angle. A receiving recess 112 in which a hinge coupling part 230, that will be described later, of the support bracket 200 is received is defined in a lower end of the hinge 110.

A shaft 114 protrudes downwardly from a central portion of the receiving recess 112. The shaft 114 is inserted into the hinge coupling part 230 to form a rotation center of the hinge 110.

An upper end and a lower end of the shaft 114 are different in cross-sectional size, thereby being capable of performing an auto closing function.

In detail, the shaft 114 includes a hinge hook end 114*a* and a hinge insertion end 114*b*. The hinge hook end 114*a* has a cylinder shape in which portions of both sides thereof are cut. The hinge insertion end 114*b* extends downwardly from the hinge hook end 114*a*.

The hinge insertion end 114*b* has a cylinder shape and is inserted into a hinge through hole 234 of the hinge coupling part 230.

The hinge stopper 120 includes a hinge joint part 122 and a door coupling part 124. The hinge joint part 122 is coupled to an outer circumference of an end portion of the hinge 110 by caulking. The door coupling part 124 extends horizontally from an outer circumference of the hinge joint part 122.

The hinge joint part 122 has a pipe shape having an inside diameter greater than an outer diameter of the end portion of the hinge 110. In a state where the hinge 110 is inserted into the hinge joint part 122, a receiving part 123 receiving a portion of the height adjustment unit 300 is provided in the hinge joint part 122.

A through hole 125 through which a coupling member such as a screw passes is defined in the door coupling part 124.

The height adjustment unit 300 for vertically moving the refrigerating compartment door 32 is disposed under the hinge stopper 120.

The height adjustment unit 300 includes a fixing part 310, a door bracket 320, and an adjustment part 330. The fixing part 310 has one end supported by the support bracket 200. The door bracket 320 is coupled to the lower side of the refrigerating compartment door 32, and the fixing part 310 passes through the door bracket 320. The adjustment part 330 is coupled to the fixing part 310 passing through the door bracket 320 to vertically move the refrigerating compartment door 32.

In detail, the fixing part 310 has a hollow cylinder shape, and the shaft 114 passes through the fixing part 310.

The fixing part 310 has one end coupled to the door bracket 320 to fixing part 310 to a bottom suffice of the refrigerating compartment door 32 and the other end supported by the support bracket 200 to the fixing part 310 to the adjustment part 330. Thus, the bottom suffice of the refrigerating compartment door 32 is spaced a predetermined distance from the support bracket 200.

A hook end 312 protruding from an outer circumference of the fixing part 310 is disposed on an upper end of the fixing part 310. In a state where the hook end 312 interferes with a top suffice of the door bracket 320 to prevent the fixing part 310 from being downwardly separated from the door bracket 320 when the hook end 312 is inserted into an insertion hole 328 of the door bracket 320, the fixing part 310 is fixed to the bottom suffice of the refrigerating compartment door 32 by the door bracket 320.

A screw thread is provided on an outer circumference of the fixing part 310 to screw-couple the fixing part 310 to the adjustment part 330. Thus, the adjustment part 330 is rotated in a clockwise direction or a counterclockwise direction along the screw thread provided on the outer circumference of the fixing part 310 to upwardly or downwardly move the adjustment part 330. As a result, the refrigerating compartment door 32 is forcedly moved in an upward or downward direction. The refrigerating compartment door 32 is movable up to a vertical height of the screw thread of the fixing part 310.

A guide recess 316 is vertically provided along the outer circumference of the fixing part 310. The guide recess 316 has a shape corresponding to that of a guide protrusion 329 provided on the door bracket 320 and guides movement of the guide protrusion 329.

The door bracket 320 includes a coupling end 322 coupled to a bottom suffice of the hinge stopper 120 and a front suffice cover 326 extending downwardly from the coupling end 322.

The coupling end 322 includes the insertion hole 328 in which the fixing part 310 is inserted and a coupling hole 323 punched at a position corresponding to that of the through hole 125.

The insertion hole 328 has a diameter greater than that of the outer circumference of the fixing part 310. The guide protrusion 329 inserted into the guide recess 316 protrudes from an inner circumference of the insertion hole 328.

The front suffice cover 326 covers the fixing part 310 and the adjustment part 330 to prevent the fixing part 310 and the adjustment part 330 from being exposed to the outside when the door bracket 320 is coupled to the refrigerating compartment door 32.

A coupling process of the door bracket 320 and the hinge assembly 100 will now be briefly described.

In a state where the fixing part 310 is inserted into the insertion hole 328, the door bracket 320 is closely attached to the bottom surface of the hinge stopper 120. Then, the coupling member such as the screw passes through the coupling hole 323 and the through hole 125.

The adjustment part 330 is disposed under the door bracket 320. For example, the adjustment part 330 may includes a nut in which a screw thread is provided on an inner circumference, and an outer circumference has a polygonal shape.

The adjustment part 330 is screw-coupled to the screw thread provided on the outer circumference of the fixing part 310. The adjustment part 300 is closely attached to the bottom suffice of the door bracket 320 to vertically move the door bracket 320.

Since the adjustment part 330 is rotated in the clockwise direction or the counter-clockwise direction, the door bracket 320 is vertically moved. Since the door bracket 320 is coupled to the refrigerating compartment door 32, the refrigerating compartment door 32 is vertically moved also when the door bracket 320 is vertically moved.

The support bracket 200 has a substantially "ㄱ" shape in side section. The support bracket 200 includes a joint part 210 coupled to a front suffice of the body 10 and a door support part 220 horizontally bent from the joint part 210 to support a load of the refrigerating compartment door 32.

A plurality of joint holes 212 through which a coupling member for coupling the support bracket 200 to the front suffice of the body 10 passes is defined in the joint part 210.

The door support part 220 is formed of an iron material having a sufficient hardness enough to support the load of the refrigerating compartment door 32 and supports a lower end of the fixing part 310. Washers W are provided on lower ends of the fixing part 310 and the door support part 220, respectively.

The hinge coupling part 230 in which the shaft 114 of the hinge 110 is inserted is provided on the joint part 210. The hinge coupling part 230 has a hollow pipe shape, and the hollow has a shape corresponding to that of the shaft 114 such that the shaft 114 is inserted into the hollow.

That is, the hinge coupling part 230 includes a hinge hook recess 232 and a hinge through hole 234 respectively corresponding to the hinge hook end 114*a* and the hinge insertion end 114*b*.

Hereinafter, an adjustment operation of the refrigerator including the above-described components will be described with reference to FIGS. 1 to 4.

In case where the refrigerator 1 is installed on an uneven floor, or the refrigerating compartment door 32 is biased towards one side due to weights of the doors 22 and 32 and goods stored in the doors 22 and 32 because the refrigerator 1 is used for a long time, the pair of refrigerating compartment doors 32 may be different from each other in height.

At this time, the refrigerating compartment door 32 can be moved upwardly using the adjustment part 330 provided on a lower end of the refrigerating compartment door 32 having a relatively low height to equally adjust the heights of the pair of refrigerating compartment doors 32.

In detail, as illustrated in FIG. 2, a tool such as a wrench is inserted from a side direction of the refrigerator 1 into a space between the support bracket 200 and the lower end of the refrigerating compartment door 32 to rotate the adjustment part 330 in one direction (for example, the clockwise direction).

As a result, the adjustment part 330 is moved upwardly along the screw thread provided on the outer circumference of the fixing part 310 to upwardly move the bottom suffice of the door bracket 320 coupled to the bottom surface of the refrigerating compartment door 32. Therefore, the refrigerating compartment door 32 is moved upwardly.

On the other hand, when it is required to lower the height of the refrigerating compartment door 32 having a relatively high height, the adjustment part 330 is rotated in the other direction (for example, the counterclockwise direction).

As a result, the adjustment part 330 is moved downwardly along the screw thread provided on the outer circumference of the fixing part 310 to downwardly move the refrigerating compartment door 32 having the relatively high height due to the load of the refrigerating compartment door 32. Therefore, the pair of refrigerating compartment doors 22 and 32 have the same height as each other.

Figure 5:
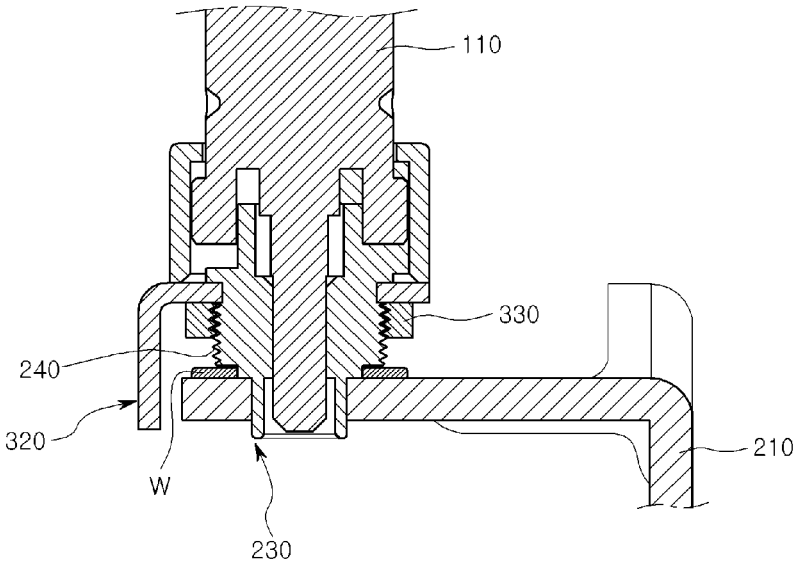
FIG. 5 is a cross-sectional view taken along line I-I of FIG. 3 according to another embodiment.

FIG. 5 is a cross-sectional view taken along line I-I of FIG. 3 according to another embodiment.

This embodiment is almost the same as the previous embodiment except, but only different from the previous embodiment in a structure of a fixing part. Thus, only characteristics parts of this embodiment are described below, while elements that are the same as those in the previous embodiment shall be deemed already described in the description of the previous embodiment.

Referring to FIG. 5, a fixing part of this embodiment is integrated with a hinge coupling part 230 provided in a joint part 210 of a support bracket. The fixing part 240 is provided on an outer circumference (around an outer suffice) of the hinge coupling part 230 and has a screw thread. Thus, an adjustment part 330 is vertically moved by a rotation operation in a state where the adjustment part 330 is coupled to the outer circumference of the hinge coupling part 230. Therefore, a refrigerator door can be moved upwardly or downwardly.

The invention claimed is:

1. A refrigerator comprising:

a body defining a storage chamber;

a door opening and closing at least a portion of the storage chamber;

a support bracket fixed to the body and configured to support a load of the door;

a hinge that protrudes from the door toward the support bracket when the support bracket supports the load of the door, the hinge being an auto closing hinge in which the door is automatically closed when the door is rotated within a predetermined angle;

a hinge stopper fixed to an outer surface of the hinge;

a door bracket coupled to the hinge stopper;

a fixing part between the support bracket and the door bracket; and an adjustment part coupled to the fixing part, configured to support the door bracket, and configured to adjust a vertical movement of the door, wherein the support bracket comprises a hinge coupling part coupled to the hinge, and the hinge coupling part passes through the adjustment part, the fixing part, and the door bracket, wherein a receiving recess in which the hinge coupling part is received is defined in a lower end of the hinge and a shaft protrudes downwardly from the receiving recess, wherein the shaft is inserted into the hinge coupling part to form a rotation center of the hinge and an upper end and a lower end of the shaft are different in cross-sectional size, thereby being capable of performing an auto closing function.

2. The refrigerator according to claim 1, wherein the door bracket comprises an insertion hole through which the fixing part passes.

3. The refrigerator according to claim 2, wherein a guide protrusion is disposed on an inner circumference of the insertion hole, and a guide recess guiding the guide protrusion is disposed in an outer circumference of the fixing part.

4. The refrigerator according to claim 2, wherein a screw thread is disposed on an outer circumference of the fixing part, and a screw thread is disposed on an inner circumference of the adjustment part.

5. The refrigerator according to claim 1, wherein the adjustment part is rotatably coupled to the fixing part, the door is upwardly moved when the adjustment part is rotated in one direction, and the door is downwardly moved when the adjustment part is rotated in the other direction.

6. The refrigerator according to claim 1, wherein the adjustment part is between the support bracket and the door bracket.

7. The refrigerator according to claim 1, wherein the hinge stopper is attached to a lower side of the door.

8. The refrigerator according to claim 1, wherein the hinge protrudes from a lower side of the door.

9. A refrigerator comprising:

a body defining a storage chamber;

a door opening and closing at least a portion of the storage chamber;

a support bracket fixed to the body;

a hinge that protrudes from the door toward the support bracket when the support bracket supports the load of the door;

a hinge stopper fixed to an outer surface of the hinge;

a door bracket coupled to the hinge stopper;

a fixing part passing through the door bracket, the fixing part being supported by the support bracket; and an adjustment part configured to support the door bracket, the adjustment part being relatively movably coupled to the fixing part, wherein the door is moved upwardly or downwardly according to a movement of the adjustment part, wherein the support bracket comprises a hinge coupling part coupled to the hinge, and the hinge coupling part passes through the adjustment part, the fixing part, and the door bracket wherein the door bracket is moved upwardly or downwardly when the adjustment part is rotated, the fixing part comprises a guide recess to guide a movement of the door bracket, and the door bracket comprises a guide protrusion inserted into the guide recess.

10. The refrigerator according to claim 9, wherein the adjustment part is rotatably coupled to the fixing part.

11. The refrigerator according to claim 9, wherein a screw thread is disposed on an outer circumference of the fixing part, a screw thread engaged with the screw thread of the fixing part is disposed on an inner circumference of the adjustment part.

12. The refrigerator according to claim 9, wherein the hinge includes an auto closing hinge in which the door is automatically closed when the door is rotated within a predetermined angle.

* * * * *